US008839465B2

(12) United States Patent
Kolcheh

(10) Patent No.: US 8,839,465 B2
(45) Date of Patent: Sep. 23, 2014

(54) TOILET CLEANING SYSTEM

(76) Inventor: Yaacov Kolcheh, Yavne (IL)

( * ) Notice: Subject to any disclaimer, the term of this patent is extended or adjusted under 35 U.S.C. 154(b) by 523 days.

(21) Appl. No.: 12/710,427

(22) Filed: Feb. 23, 2010

(65) Prior Publication Data

US 2011/0203041 A1 Aug. 25, 2011

(51) Int. Cl.

| | |
|---|---|
| ***E03D 9/02*** | (2006.01) |
| ***E03D 9/03*** | (2006.01) |
| ***E03D 11/14*** | (2006.01) |

(52) U.S. Cl.

CPC ..... *E03D 9/031* (2013.01); *E03D 2009/024* (2013.01); *E03D 9/038* (2013.01); *E03D 11/143* (2013.01)

USPC ..... 4/226.1

(58) Field of Classification Search

CPC ..... E03D 9/031

USPC ..... 4/222, 226.1

See application file for complete search history.

(56) References Cited

U.S. PATENT DOCUMENTS

| | | | | |
|---|---|---|---|---|
| 960,984 | A * | 6/1910 | Melville | 4/226.1 |
| 4,583,250 | A | 4/1986 | Valarao | |
| 4,984,307 | A * | 1/1991 | Thomas | 4/226.1 |
| 6,738,989 | B2 | 5/2004 | Harbutt et al. | |
| 6,772,450 | B1 | 8/2004 | Saylor et al. | |
| 6,804,837 | B1 | 10/2004 | Guess et al. | |
| 2002/0069457 | A1 * | 6/2002 | Meier et al. | 4/226.1 |
| 2011/0252552 | A1 * | 10/2011 | Janssen | 4/311 |

FOREIGN PATENT DOCUMENTS

| | | |
|---|---|---|
| GB | 17085 | 0/1910 |
| GB | 466414 | 5/1937 |
| WO | WO01/90494 | 11/2001 |

* cited by examiner

*Primary Examiner* — Lori Baker

(74) *Attorney, Agent, or Firm* — Edward Langer

(57) ABSTRACT

A toilet cleaning system, using a bifurcated communicating pipe which provides cleansing material to a toilet bowl. The system is provided as a component of a water closet, which is inexpensive to manufacture, and is capable of delivering a limited amount of cleanser to the toilet, while preventing accidental flushing of the cleanser unit into the toilet bowl. The bifurcated communicating pipe has an angled branch and allows a portion of the cleanser unit seated in the angled branch to project into the central channel of the communicating pipe for contacting the flush water, to provide cleansing action. The flush water passing through the communicating pipe dissolves or disperses a certain amount of the cleanser and therefore provides cleansing of the flush water. Optionally, a removable cap is present for sealing the angled branch, to prevent the flush water from exiting the angled branch. Anchoring means are provided for anchoring a cleanser unit within the angled branch.

11 Claims, 5 Drawing Sheets

TOILET CLEANING SYSTEM

FIELD OF THE INVENTION

The invention relates to toilet cleaning systems, more particularly, to a pipe for a water closet, designed to eliminate odors emitting from the toilet bowl, and provide cleansing of the toilet bowl.

BACKGROUND OF THE INVENTION

Typically, in a water closet of the type having a toilet bowl with a rim, a water tank is present, and a downward cascade of water is provided and introduced into the bowl through a passageway, and through a plurality of openings under the bowl rim, when the toilet is flushed. Valve means are provided within the tank for opening and closing the passageway for flushing the toilet into a sewer pipe and for interchanging the water in the bowl.

Numerous attempts have been made to eliminate or reduce the odor emitted from toilets, these including fans and vacuum devices (U.S. Pat. No. 6,804,837, U.S. Pat. No. 4,583,250) as well as specialized dispensers for soaps which are placed in various positions within the toilet (U.S. Pat. No. 6,738,989). Specific components of the water closet have similarly been modified to address this issue, (see for instance U.S. Pat. No. 6,772,450).

The need nevertheless exists for an inexpensive solution to the problem of odors and for improved delivery of a cleanser to the toilet.

In many prior art delivery systems for cleansers, the cleanser is placed within the water tank, where it dissolves or diffuses into the contents of the tank. The disadvantage of this system is that a large quantity of cleanser diffuses in close proximity to the time when it is first introduced into the tank, with little remaining after several days. This represents a waste, and requires frequent addition of cleanser material.

In other prior art toilet cleaning systems, a solid bar of soap is hung by a plastic holder under the rim of the toilet bowl, and the flush water acts to dissolve a certain amount of soap with each flush. The disadvantage of this cleanser delivery system is that it may become dislodged from the toilet rim to fall within the bowl, and accidentally flushed into the U pipe behind the toilet, which connects the bowl with the sewage system. This can result in clogging of the pipes, and requires great effort in retrieval of the dislodged cleanser holder.

Therefore, it would be desirable to provide an inexpensive and easily installed toilet cleaning system with improved delivery of the cleanser material.

SUMMARY OF THE INVENTION

Accordingly, it is a principal object of the present invention to overcome the disadvantages of prior art, and provide a toilet cleaning system, using a bifurcated communicating pipe which provides cleansing material to a toilet bowl.

It is another object of the present invention to provide a component of a water closet, which is inexpensive to manufacture, and is capable of delivering a limited amount of cleanser to the toilet, while preventing accidental flushing of the cleanser unit into the toilet bowl.

In accordance with a preferred embodiment of the present invention, there is provided a toilet cleaning system comprising:

a bifurcated communicating pipe comprising:

a central channel; and an angled branch for insertion of a cleanser unit into the branch, wherein the bifurcated communicating pipe allows a portion of the cleanser unit to project into the central channel of the communicating pipe for contacting the flush water, to provide cleansing action.

The flush water passing through the communicating pipe dissolves or disperses a certain amount of the cleanser and therefore provides cleansing of the flush water.

Optionally, a removable cap is present for sealing the angled branch, to prevent the flush water from exiting the angled branch. In such case, in certain embodiments, the branch end is formed with screw-type connection threads to accept the removable cap.

In certain embodiments, anchoring means are provided for anchoring a cleanser unit within the angled branch, and for preventing entry of the cleanser unit into the toilet bowl through the communicating pipe. The anchoring means may be a circular flange formed on a cleanser unit holder. Optionally, the cleanser unit is covered by a removable cap, with the cap being suited to mate with and seal the angled branch.

According to a preferred embodiment, the angled branch lies in the plane parallel to the wall upon which the toilet is mounted.

According to other preferred embodiments, the angled branch allows a cleanser unit inserted within to project into the central channel to a depth of 1-1.5 cm.

Moreover, optionally, the junction between the communicating pipe and the angled branch comprises an internal structure preventing a cleanser unit from passing through the communicating pipe to the toilet bowl. Preferably, the internal structure is selected from: a narrowing of the angled branch, a protuberance in the angled branch, and a protuberance in the communicating pipe.

Further, according to certain embodiments, a sealing internal ring member is present in the angled branch to prevent the flush water from flowing upward and out of the angled branch.

Preferably, the communicating pipe is manufactured of plastic.

Additional features and advantages of the invention will become more apparent from the detailed description of the invention and the accompanying drawings, which follow.

BRIEF DESCRIPTION OF THE DRAWINGS

For a better understanding of the invention with regard to the preferred embodiments, reference is made to the accompanying drawings, in which like numerals designated corresponding elements or sections throughout, and in which.

DETAILED DESCRIPTION OF THE PREFERRED EMBODIMENTS

It will be appreciated that the detailed description that follows is intended only to illustrate certain preferred embodiments of the present invention. It is in no way intended to limit the scope of the invention, as set out in the claims.

The invention discloses a pipe unit situated between the water tank and the toilet bowl, having a T branch into which a cleanser unit can be inserted to partially project into the path of the flush water.

Figure 1:
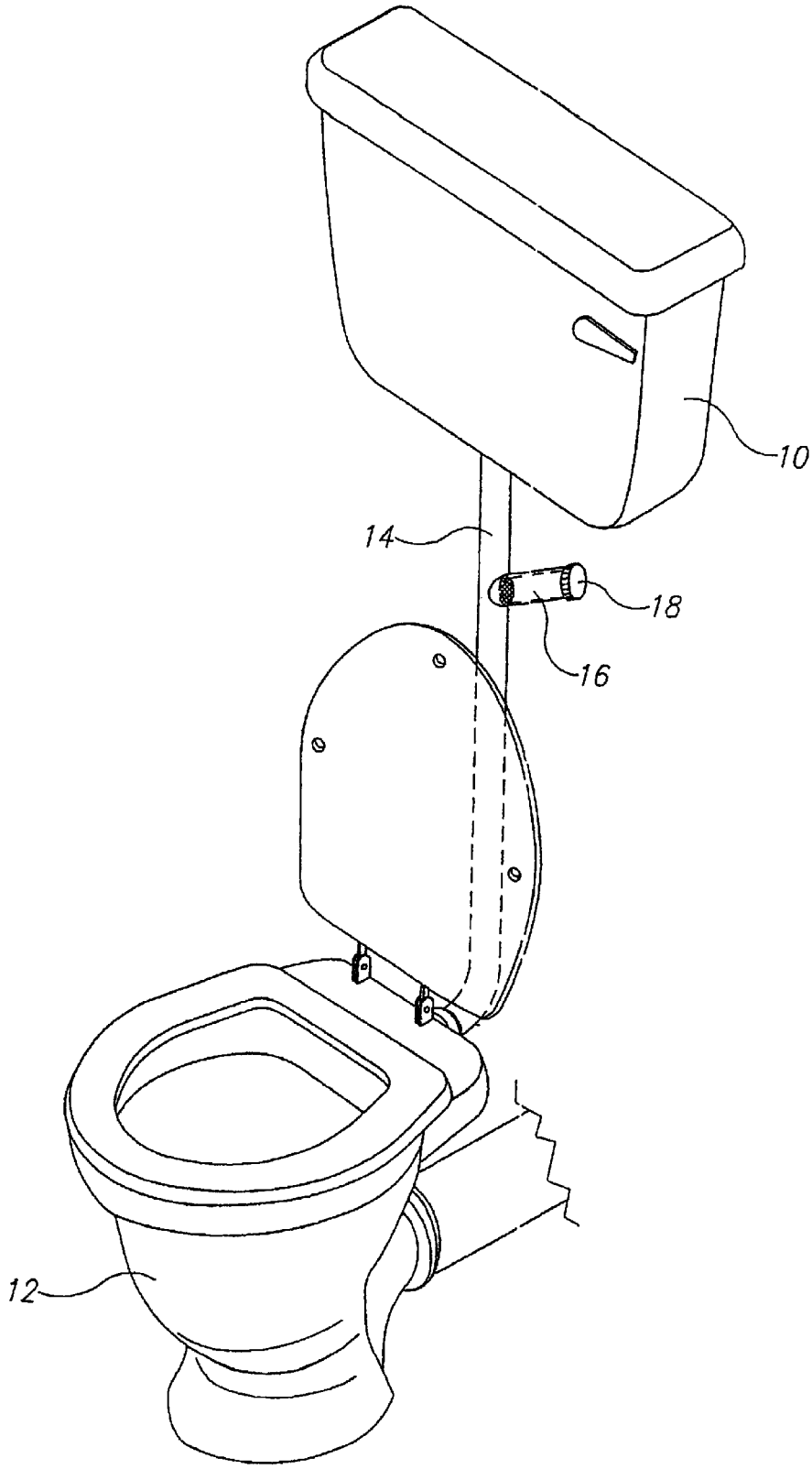
FIG. 1 is a perspective view of a water closet having a bifurcated communicating pipe into which a cleanser can be inserted to project into the path of the flush water.

Referring now to FIG. 1, a water closet consists of a water tank 10, containing a flush mechanism and connected to a water supply, so that water within the tank can be flushed into the toilet bowl 12 and then replenished. Water is passed from the water tank 10 through a communicating pipe 14 into the toilet bowl 12. In the invention, the communicating pipe 14 is bifurcated, with an angled branch 16 in the communicating pipe 14, enabling introduction of a cleanser unit containing a solid or semi-solid cleanser, into the branch 16 so that a portion of the cleanser projects into the communicating pipe 14. When the flush mechanism is activated by the user, flush water will contact the projecting end of the cleanser and wash a certain amount of the cleanser into the toilet bowl 12.

Preferably, a removable cap 18 prevents the flush water from rising and exiting the angled branch 16, and the cap may be secured by a screw-type threaded connection onto the angled branch 16.

The angled branch 16 lies in the plane parallel to the wall upon which the toilet is mounted, and therefore does not contact or discomfort the user.

Figure 2A:
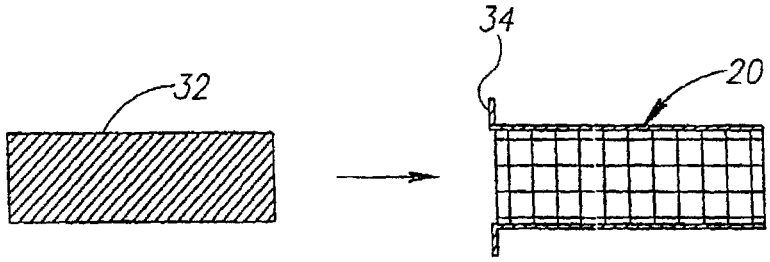
FIG. 2A is a side view of a cleanser being inserted into a cleanser mesh-type holder.

Referring to FIG. 2A, preferably the cleanser unit is comprised of:

a) a solid cleanser 32 having disinfectant capability, and b) a cylindrical mesh-type holder 20, for accepting and holding the solid cleanser 32 within.

In the embodiment shown in FIG. 2, the mesh-type holder 20 has a circular flange 34 formed on its distal end, for anchoring the mesh-type holder 20 within the angled branch at the proper height. The flange 34 protrudes out of the distal end of the angled branch, and prevents the cleanser unit from entering into the central channel of the communicating pipe.

Figure 2B:
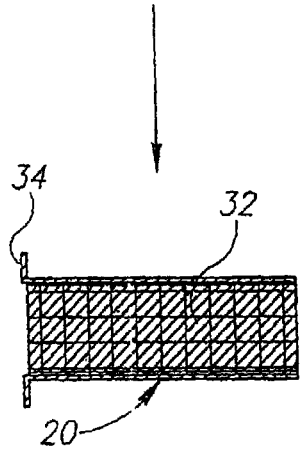
FIG. 2B is a cleanser within a mesh-type holder.

In FIG. 2B the cleanser 32 is shown within the mesh-type holder 20, ready for insertion into the angled branch. The mesh-type holder 20 is preferably made of plastic, and is reusable so that when the solid cleanser 32 is finished after being washed away over time by the flush water, the mesh-type holder 20 can be removed from the angled branch and a new solid cleanser 32 can be inserted within the mesh-type holder 20.

Figure 3A:
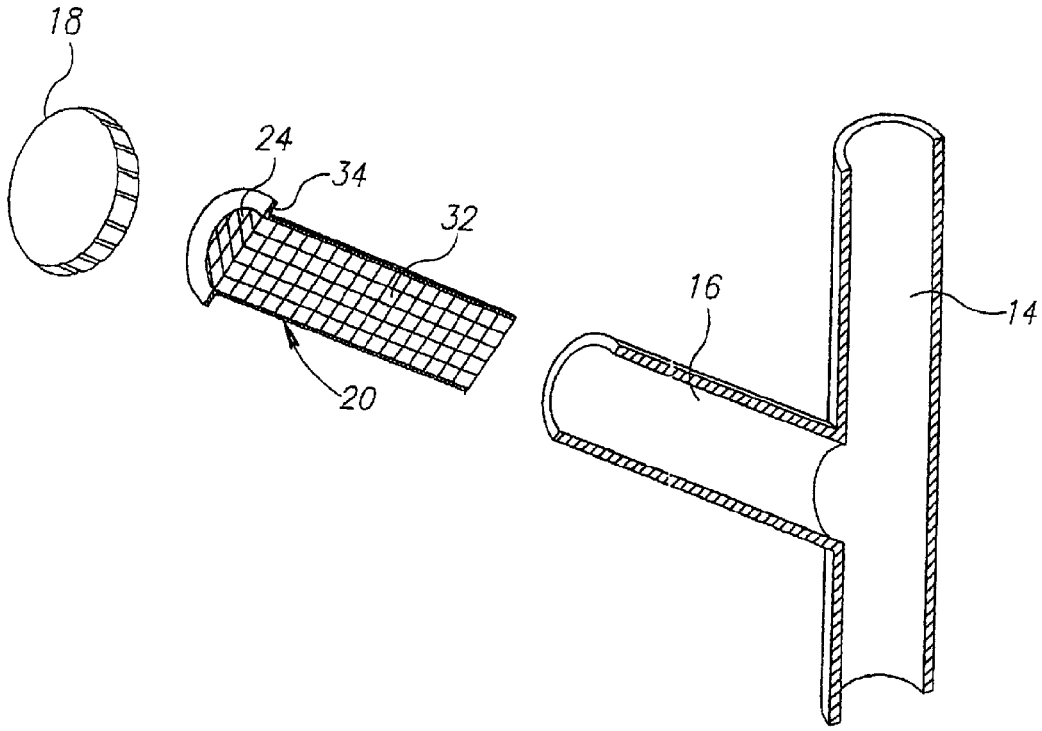
FIGS. 3A and 3B are enlargements of the bifurcated communicating pipe, showing the central pipe and angled branch in cross-section, either before (FIG. 3A) or after (FIG. 3B) insertion of a cleanser unit within the angled branch.

Referring to FIG. 3A, the bifurcated communicating pipe 14 with angled branch 16 is shown enlarged, with both the central channel of the communicating pipe 14, and the angled branch 16 shown in cross-section. The solid cleanser 32 has been placed within the mesh-type holder 20, as described above. Before the first use, the distal end 24 of the cleanser mesh-type holder 20 is placed in the angled branch 16 such that flange 34 is seated on the end of angled branch 16. This ensures the cleanser unit will not fall into the depths of the communicating pipe 14 and travel to the toilet bowl. After insertion of the cleanser unit into the angled branch 16, the cap 18 is screwed on, and the system is ready for use.

Figure 3B:
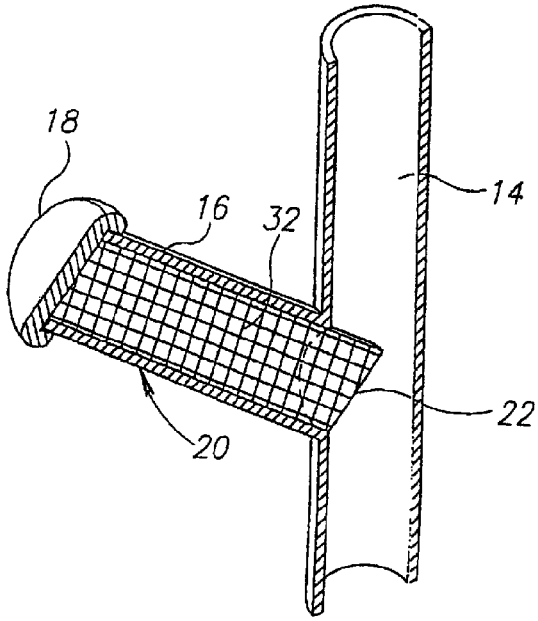

Referring to FIG. 3B, the cleanser within the mesh-type holder 20 has been inserted into the angled branch 16. The proximal end 22 of the cylindrical mesh-type holder 20 projects to a depth of approximately 1-1.5 cm into the central channel of the communicating pipe 14, allowing contact of the flush water with the cleanser 32 during flushing.

It will be appreciated that although the cleanser unit has being described as being placed within a cylindrical holder, other holders may be utilized. These will have other means of anchorage, such as tongues or fingers that protrude at the distal end. Similarly the area where the communicating pipe meets the angled branch may have an internal structure that prevents the entire cleanser holder from traveling through the communicating pipe to the toilet bowl. This may take the form of a narrowing of the angled branch or of a protuberance in the communicating pipe or in the angled branch. In such case, solid or semi-solid cleansers of appropriate shapes that are not contained within a holder may be used.

A sealing internal ring member may be included in the angled branch to prevent the flush water from flowing upward and out of the angled branch.

The bifurcated pipe, the cap and the cleanser holder are inexpensive to manufacture and to install, and are typically made of materials known in the art. Preferably, these are made of plastic.

Since the cleanser contacts and becomes dissolved in the flush water, it will reach a large portion of the bowl. This is in contrast to prior art cleansers which are attached to the bowl rim, and are mainly effective in washing the area directly below the attachment point, and not over the entire bowl surface.

The present invention thus provides delivery of a cleanser to the toilet bowl, with only a limited amount of cleanser being dispensed at each use. The invention allows a cleanser to be dispensed, while preventing the cleanser unit from entering the toilet bowl and from subsequently entering the connecting pipes and the sewer system.

Figure 4:
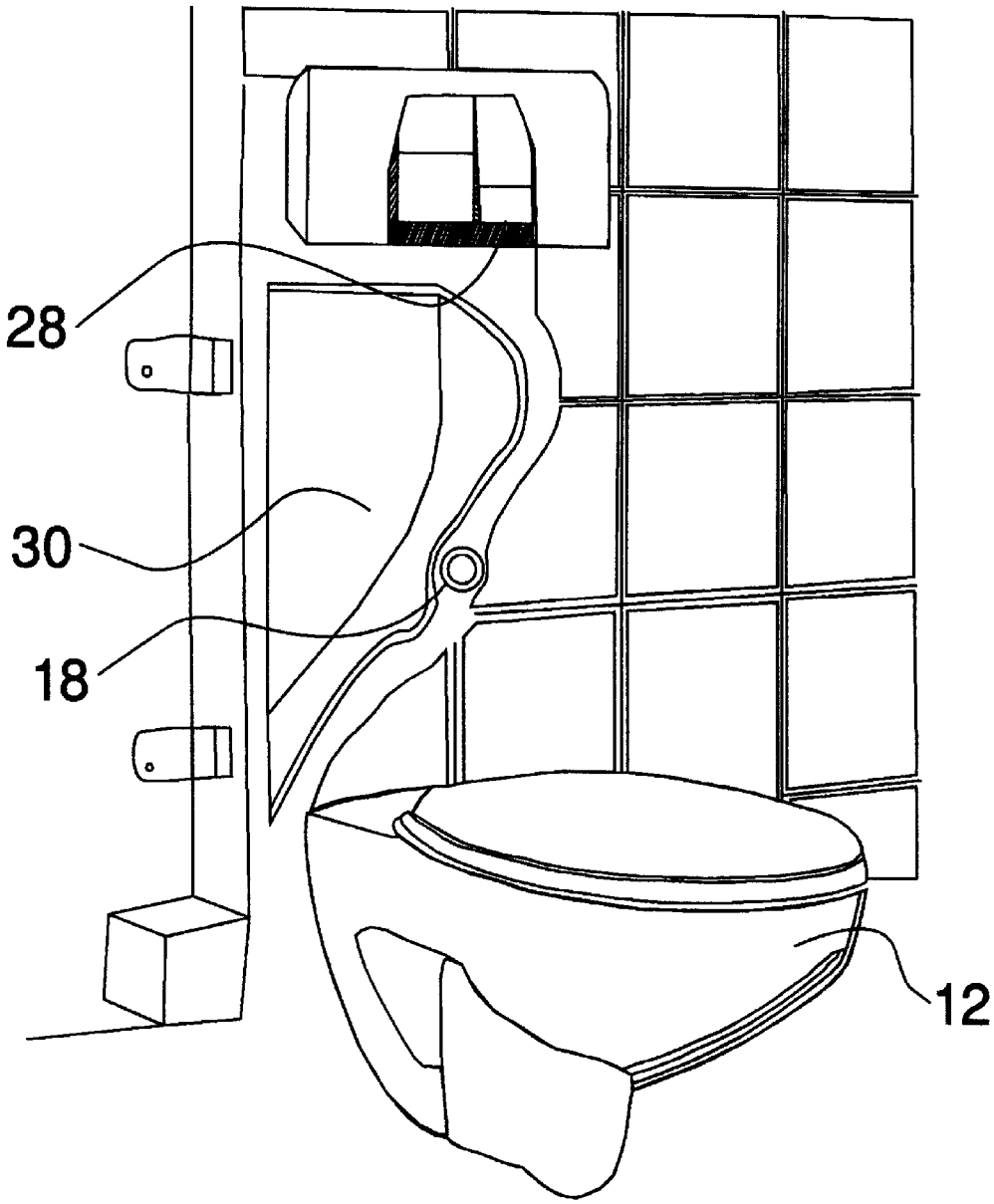
FIG. 4 is a perspective view of a water closet with a hidden water tank, having the bifurcated communicating pipe into which a cleanser can be inserted to project into the path of the flush water, according to another embodiment.

FIG. 4 is a perspective view of a water closet with a hidden water tank, having the bifurcated communicating pipe into which a cleanser can be inserted to project into the path of the flush water, according to another embodiment.

A water closet with a hidden water tank consists of water tank 10 (not shown) hidden behind a plasterboard wall 30 covered by tiles. A flush mechanism controlled by buttons 28, and connected to the water supply, flushes water within tank 10, through communicating pipe 14 (hidden), into the toilet bowl 12 and then replenished.

In the invention, the hidden communicating pipe 14 (not shown) is bifurcated with the angled branch 16 (not shown) in the communicating pipe 14. The angled branch 16 protrudes out of the wall 30 and, preferably, is covered by the removable cap 18.

Figure 5:
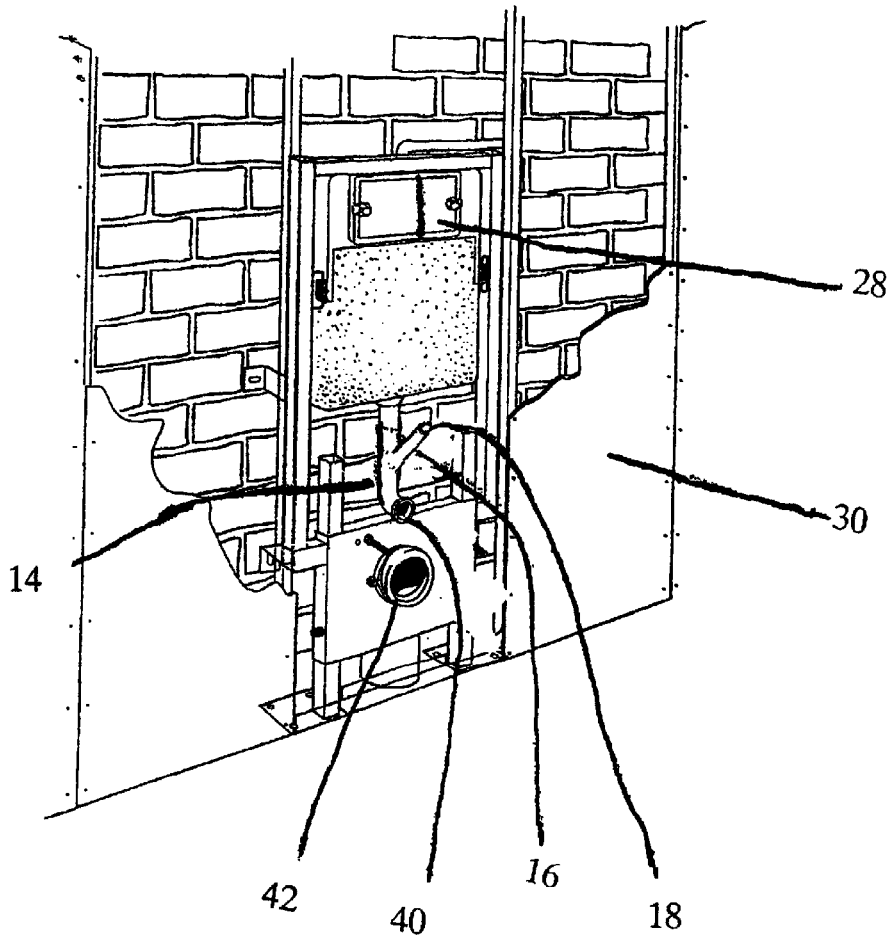
FIG. 5 is a perspective view of the hidden components of the water closet with a hidden water tank, having the bifurcated communicating pipe of FIG. 4.

FIG. 5 is a perspective view of the hidden components of the water closet with a hidden water tank, having the bifurcated communicating pipe of FIG. 4.

In addition to the prior art inlet 40 and outlet 42, branch 16 also protrudes out of plasterboard wall 30. Communicating pipe 14 is bifurcated, with the angled branch 16 in the communicating pipe 14, enabling introduction of the cleanser unit (comprising the solid cleanser 32 and the holder 20), through the wall 30, into the branch 16.

Having described the invention with regard to certain preferred embodiments, it is to be understood that the description is not meant as a limitation, since further modifications may now suggest themselves to those skilled in the art, and it is the intention to cover modifications which fall within the scope of the appended claims.

The invention claimed is:

1. A toilet cleaning system for providing cleansing of a toilet bowl having a water tank fillable with flushable water, comprising:

a toilet;

a solid or semi-solid cleanser unit;

a wall situated between said toilet and the water tank for the purpose of hiding said water tank; and a bifurcated communicating pipe, for installation and communication between the water tank and the toilet bowl, said communicating pipe comprising:

a central channel for the flush water;

a single angled branch not for the flush water; and anchoring means for anchoring the cleanser unit within said angled branch, wherein said single angled branch, lies in a plane parallel to said wall upon which said toilet is mounted, so as not to contact or discomfort the user, for insertion of said cleanser unit therewithin, wherein said bifurcated communicating pipe allows only a portion at a bottom end of said cleanser unit to project into said central channel of said bifurcated communicating pipe for contacting the flush water, to provide cleansing action, such that the flush water gradually consumes said cleanser from said bottom end, thereby causing said cleanser unit to gradually advance downwards automatically by force of gravity within said anchoring means in said angled branch until substantially consumed.

2. The system of claim 1, further comprising a removable cap for sealing said angled branch.

3. The system of claim 2, wherein an end of said angled branch end is formed with a threaded connection to accept said removable cap.

4. The system of claim 1, wherein said anchoring means for anchoring said cleanser unit within said angled branch are for preventing entry of said cleanser unit into the toilet bowl through said communicating pipe.

5. The system of claim 4, wherein said anchoring means comprises a circular flange formed on a cylindrical mesh holder.

6. The system of claim 1, wherein said angled branch allows a cleanser unit inserted therewithin to project into said central channel to a depth of 1-1.5 cm.

7. The system of claim 1, further comprising a junction between said bifurcated communicating pipe and said angled branch, said junction comprising an internal structure preventing said cleanser unit from passing through said communicating pipe to the toilet bowl.

8. The system of claim 7, wherein said internal structure is selected from a group including a narrowing of said angled branch, a protuberance in said angled branch, and a protuberance in said communicating pipe.

9. The system of claim 1, wherein said communicating pipe is manufactured of plastic.

10. The system of claim 1, wherein said angled branch protrudes out of a wall, behind which said communicating bifurcated pipe and the water tank are hidden.

11. A method of cleansing a toilet bowl having a water tank fillable with flushable water, with the water tank being hidden behind a wall, said method comprising: a) providing and installing a bifurcated communicating pipe for communication between the water tank and a toilet bowl, said communicating pipe comprising:

a central channel for the flush water;

a single angled branch not for the flush water; and anchoring means for anchoring said cleanser unit within said angled branch, wherein said angled branch lies in a plane parallel to said wall upon which said toilet is mounted, for insertion of a solid or semi-solid cleanser unit into said branch, wherein said bifurcated communicating pipe allows only a portion at a bottom end of said cleanser unit to project into said central channel of said communicating pipe for contacting the flush water; b) inserting said cleanser unit into said angled branch of said bifurcated communicating pipe; and c) flushing the water in the water tank, thereby allowing contact of said cleanser unit with the flush water and cleansing of the toilet bowl, said flush water gradually consuming said cleanser from said bottom end, thereby causing said cleanser unit to gradually advance downwards automatically by force of gravity within said anchoring means in said angled branch until substantially consumed.

* * * * *